United States Patent [19]

Saferstein et al.

[11] Patent Number: 4,819,670

[45] Date of Patent: Apr. 11, 1989

[54] FLEXIBLE LICE COMB

[76] Inventors: Albert Saferstein; Gilbert Spector, both of 2500 Westchester Ave., Purchase, N.Y. 10577; Larry Tsuyuki, 116 Brown Rd., Scarsdale, N.Y. 10583

[21] Appl. No.: 87,531

[22] Filed: Aug. 20, 1987

[51] Int. Cl.[4] ..... A45D 24/00

[52] U.S. Cl. ..... 132/156; 132/219

[58] Field of Search ..... 132/156, 151, 152, 155, 132/159, 160, 11 R; 15/186, 187, 188, 144 R; 401/281

[56] References Cited

U.S. PATENT DOCUMENTS

| | | | |
|---|---|---|---|
| 581,040 | 4/1897 | Schulz | 132/156 |
| 982,918 | 1/1911 | Winn | 132/11 R |
| 2,167,523 | 7/1939 | Reichenbach | 401/281 |
| 2,571,205 | 10/1951 | Cosby | 132/156 |
| 3,142,305 | 7/1964 | Cosby | 132/155 |
| 3,551,936 | 1/1971 | Kutik et al. | 15/187 |
| 4,502,498 | 3/1985 | Saferstein et al. | 132/137 |
| 4,513,842 | 4/1985 | Karlsberg | 132/11 R |
| 4,612,944 | 9/1986 | Bachrach et al. | 132/159 |
| 4,671,303 | 6/1987 | Saferstein et al. | 132/11 R |

*Primary Examiner*—Paul J. Hirsch

*Attorney, Agent, or Firm*—Sprung Horn Kramer & Woods

[57] ABSTRACT

A lice comb comprises a handle and a resiliently flexible elongated member having the end portions thereof connected to the handle and teeth mounted outwardly from the member and extending in the same plane as the handle. A manually movable cam member is mounted on the handle and contacts the member opposite the side holding the teeth and intermediate of the end portions to flex the member outwardly relative to the handle between a minimum flexure position wherein the teeth have a minimum spacing therebetween and a maximum flexure position wherein the teeth have a maximum spacing therebetween. As a result the comb can be used for different textures of hair and the teeth can be easily cleaned.

6 Claims, 2 Drawing Sheets

FLEXIBLE LICE COMB

BACKGROUND OF THE INVENTION

The present invention relates to a flexible comb for use in the removal of nits and head lice and in particular to a comb which is adaptable to different textures of hair and which can be easily cleaned.

While general purpose flexible combs are known in the art, as well as combs which are capable of being cleaned, these combs are complex in construction or involve complex devices to effect cleaning.

Moreover, while many combs are known in the prior art which are bendable or flexible to increase or decrease the spacing between comb teeth, none of the prior art comb were capable of achieving a desired spacing of the type necessary for use in lice and nit removal and which could be retained during use and reproduced for later use after cleaning of the teeth.

SUMMARY OF THE INVENTION

The main object of the present invention is to provide a flexible lice comb which is cleanable and which can adjust to different textures of hair and which also eliminates the disadvantages of the prior art.

These and other objects and features of the present invention are achieved in accordance with the present invention by a lice comb comprising a handle, a plurality of closely spaced comb teeth mounted in a row on one side of a resiliently flexible elongated member, means connecting end portions of a member to the handle to dispose the free ends of the teeth away from the handle and manually movable means mounted on the handle for contacting the member on another side thereof opposite the side in which the teeth are mounted and intermediate at the end portions of the flexible member to flex the member outwardly relative to the handle between a minimum flexure position wherein the teeth have a minimum spacing therebetween and a maximum flexure position wherein the teeth have a maximum spacing therebetween.

The manually movable means preferably is mounted for movement on the handle into any one of a plurality of positions, each corresponding to a different amount of flexure of the member and therefore different spacing between the teeth. As a result, the spacing of the teeth can be adjusted for different texture hair such as fine and coarse hair and the maximum spacing can be obtained to easily clean between the teeth.

The manually movable means preferably comprises a cam member rotatably mounted on the handle and having a cam surface for contacting the side of the flexible member facing the handle and a lever connected to the cam and manually movable to rotate the cam.

In a particularly advantageous embodiment, detent means are provided on the lever and handle for defining predetermined positions thereof corresponding to predetermined spacings of the teeth for different texture hair.

In a particularly advantageous commercial embodiment of the present invention, the handle, flexible member and the teeth are formed in one piece and comprise plastic, preferably a high impact polypropylene or polystyrene plastic. The pieces are preferably injection molded. Likewise, the lever and cam member are formed in one piece from molded high impact polypropylene or polystyrene plastic.

In order to make the comb easy to use and easy to package, the handle, flexible member and teeth are preferably disposed and substantially the same plane and the flexible member flexes in that plane.

These and other features and advantages of the present invention will be better understood from the following detailed description taken in conjunction with the attached drawings, wherein:

DETAILED DESCRIPTION OF THE INVENTION

Figure 1:
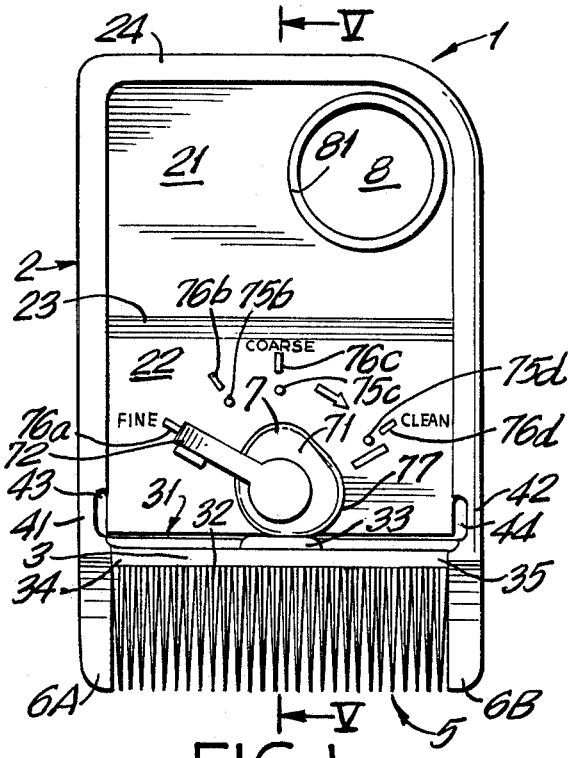
FIG. 1 is a top view of the comb in accordance with the present invention.

The comb 1 shown in FIG. 1 includes a handle 2, a resiliently flexible 3 connected at its end portions 34, 35 to the handle 2 and a plurality of closely spaced comb teeth 5 mounted in a row on one side 32 of the flexible member 3 and extending outwardly therefrom. Manually movable means 7 are mounted on the handle 2 for contacting the member 3 on side 31 thereof which is opposite side 32 at a portion which is intermediate of end portions 34 and 35. The member also includes raised portions 33, 33' (shown in FIG. 2) to increase the area contacted by cam surface 77 of cam 71 which is part of movable means 7. Integrally connected with the cam 71 is a lever 72 which enables cam 71 to be rotated about its axis formed by fastener 73 in hole 74 in the handle as can be seen in FIG. 2 and in FIG. 9.

Figure 5:
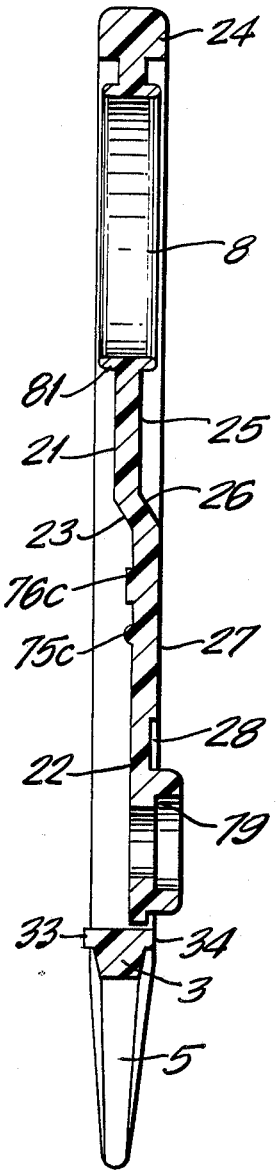
FIG. 5 is a sectional view taken along line V—V in FIG. 1.
Figure 6:
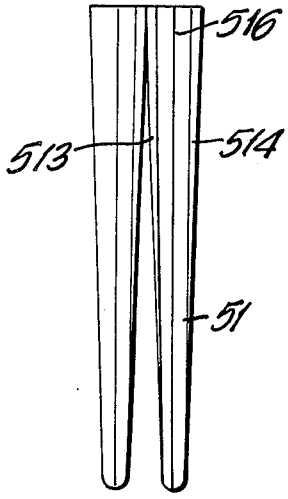
FIG. 6 is a front view of two teeth shown in FIG. 1.
Figure 7:
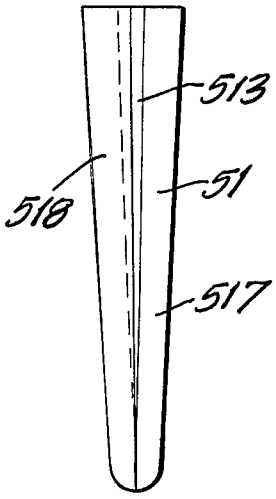
FIG. 7 is a side view of the tooth shown in FIG. 6.
Figure 8:
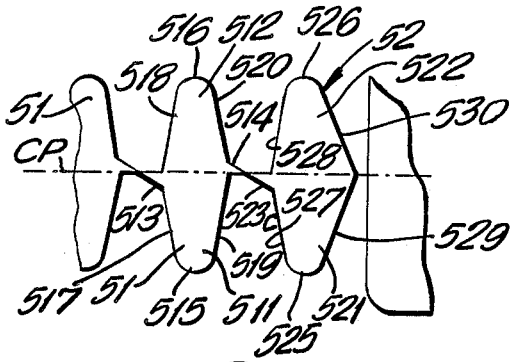
FIG. 8 is a sectional view of the cross section of the teeth shown in FIGS. 6 and 7.

The handle 2 is essentially disposed in a single plane with the member 3 and teeth 5 essentially disposed in the same plane to give the handle a planar appearance as can be seen from the cross sectional view in FIG. 5.

Figure 2:
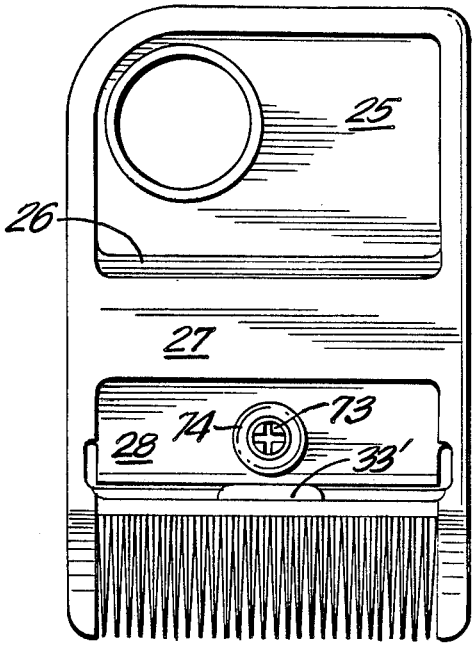
FIG. 2 is a bottom view of a comb of FIG. 1.

Referring to FIGS. 1, 2 and 5, the handle 2 includes a strengthening rib 24 surrounding same and has a first pair of opposing surfaces 21, 25 connected to a second pair of opposing surfaces 22, 27 via a diagonal ridge having surfaces 23, 26 respectively. Surface 27 has an inset portion 28. Surfaces 21 and 25 have a throughhole 81 therein which receives a plastic magnifying lens 8 force fitted therein for use with the comb.

The member 3 is connected at its end portions 34, 35 at connecting portions 41, 42 which are spaced via spaces 43, 44 from the handle surfaces 22, 28. This permits the member 30 to be easily flexed outward by the cam member 71.

Figure 3:
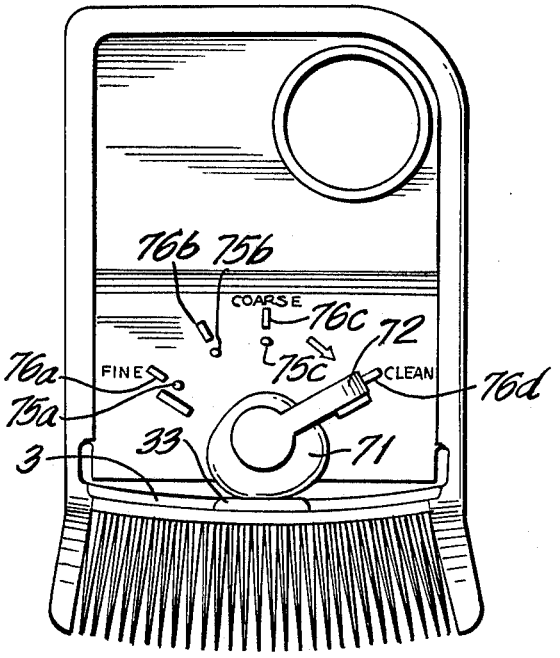
FIG. 3 is a top view of the comb of FIG. 1 in the maximum flexure position.
Figure 4:
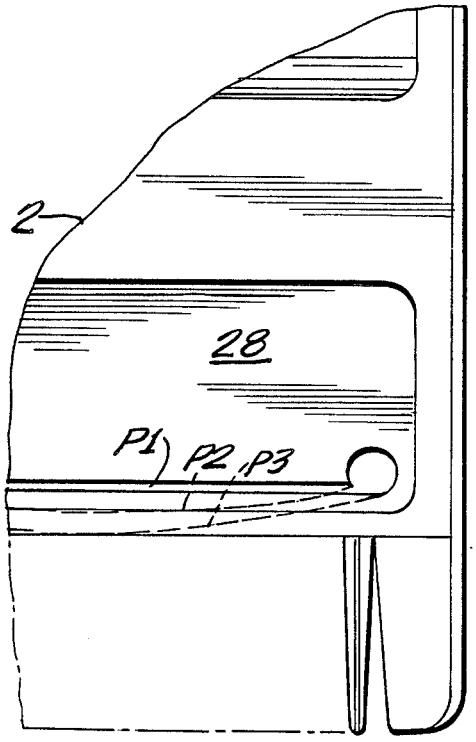
FIG. 4 is a detail of the movement of the flexible member in different positions of the cam member.

The cam surface of cam 71 is configured to flex member 3 outwardly to a greater extent as the lever 72 is moved from the position shown in FIG. 1 to the position shown in FIG. 3. FIG. 4 illustrates the different positions of member 33 as positions P1, P2 and P3 corresponding to a fine position, a coarse position and a clean position respectively.

These positions can be easily identified by markings 76*a*–76*d* on surface 22 of the handle as well as other indicia including the words "fine", "coarse" and "clean". Moreover, referring to FIGS. 1, 3 and 9 a detent including projecting dots, 75*a*–75*d* along with a detent hole 78 in lever 72 act to set a predetermined desired position of the lever and to ensure that the lever will not move when the comb is being used.

FIG. 1 shows the teeth in a closely spaced position corresponding to fine hair texture whereas FIG. 3 shows the lever in the clean position whereupon the teeth are spaced apart a maximum distance so that nits or lice can be removed from between the teeth or the teeth can be otherwise cleaned as desired.

Figure 9:
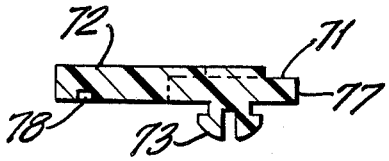
FIG. 9 is a sectional view of the lever and cam shown in FIG. 1.

Referring to FIGS. 5 and 9, the cam member 71 is held in place via a snap fitting 73 which cooperates with ridge 79 in hole 74 to maintain the axial position of the cam member while permitting it to rotate.

The teeth 5 also include the end guards 6*a* and 6*b* which are conventional in combs. The teeth 5 also includes end teeth 52 and intermediate teeth 51 each having a generally diamond shaped body having two halves 511, 512 and 521 and 522. Halves 511, 512 have two linear portions 518, 520 and 517, 519 connected by rounded edges 516 and 515 respectively. Halves 521, 522 have linear portions 528, 530 and 527, 529 connected by rounded edges 526, 525 respectively. The edges 517, 520 and 527 each have a scissor edge 513, 514, 523 extending therefrom and meeting at a center plane CP. The teeth 52 do not have the scissor edge portion on edge 530.

It will be appreciated that the instant specification and claims are set forth by way of illustration and not limitation, and that various modifications and changes may be made without departing from the spirit and scope of the present invention.

What is claimed is:

1. A lice comb comprising:

a handle;

a resiliently flexible elongated member;

a plurality of closely spaced comb teeth mounted in a row on a first side of the member and extending outwardly therefrom and wherein the teeth terminate in free ends;

means connecting end portions of the member to the handle to dispose the free ends of the teeth away from the handle; and manually movable means mounted on the handle for contacting the member on a second side opposite said first side and intermediate of the end portions thereof to flex the member outwardly relative to the handle between a minimum flexure position wherein the teeth have a minimum spacing therebetween and a maximum flexure position wherein the teeth have a maximum spacing therebetween and whereby the comb can be used for different textures of hair and the teeth can be easily cleaned, wherein the manually movable means has means mounting same for movement into any one of a plurality of positions each corresponding to a different amount of flexure by the member and thereby a different spacing between the teeth comprising a cam member rotatably mounted on the handle and having a cam surface for contacting said second side of the flexible member and a lever connected to the cam and manually movable to rotate the cam.

2. The comb according to claim 1, further comprising detent means on the lever and handle for defining predetermined positions corresponding to predetermined spacing of the teeth.

3. The comb according to claim 1, wherein the handle, the flexible member and the teeth are formed in one piece and comprise plastic.

4. The comb according to claim 1, wherein the handle, the flexible member and the teeth are disposed in substantially the same plane and wherein the flexible member flexes in said plane.

5. The comb according to claim 1, wherein each tooth has a generally diamond-shaped cross-section with rounded edges at two sides and gradually tapering in cross section towards the free end.

6. The comb according to claim 5, wherein each tooth has a center plane parallel to the member and projecting scissor edges extending from sides thereof towards adjacent teeth and having the edge thereof in the center plane.

* * * * *